US006095105A

United States Patent [19]

Lohr et al.

[11] Patent Number: 6,095,105

[45] **Date of Patent: *Aug. 1, 2000**

[54] PLENUM/RUNNER MODULE HAVING INTEGRATED ENGINE VALVE COVER

[75] Inventors: John Carl Lohr, Beverly Hills; Michael Robert Kaput, Canton; Theodore Thomas Geftos, Dearborn; William Clark Weber, Brimingham, all of Mich.

[73] Assignee: Ford Global Technologies, Inc., Dearborn, Mich.

[ * ] Notice: This patent is subject to a terminal disclaimer.

[21] Appl. No.: 09/260,329

[22] Filed: Mar. 1, 1999

[51] Int. Cl.[7] ..... F02M 35/00

[52] U.S. Cl. ..... 123/90.38; 123/184.21; 123/184.31; 123/184.34; 123/184.47; 123/572

[58] Field of Search ..... 123/90.38, 184.21, 123/184.28, 184.31, 184.34, 184.35, 184.47, 184.48, 572, 573, 574, 195 C, 198 E

[56] References Cited

U.S. PATENT DOCUMENTS

| | | | |
|---|---|---|---|
| 2,642,052 | 6/1953 | Wagner et al. | 123/119 |
| 3,233,598 | 2/1966 | Van Ranst | 123/41.74 |
| 3,961,611 | 6/1976 | Fraenkle et al. | 123/122 D |
| 4,300,511 | 11/1981 | Lang | 123/520 |
| 4,608,950 | 9/1986 | Payne et al. | 123/195 C |
| 4,811,697 | 3/1989 | Kurahashi | 123/52 MV |
| 4,919,086 | 4/1990 | Shillington | 123/52 MV |
| 4,919,087 | 4/1990 | Ogami et al. | 123/52 MV |
| 4,993,375 | 2/1991 | Akihiko | 123/90.38 |
| 5,003,933 | 4/1991 | Rush, II et al. | 123/52 MC |
| 5,022,371 | 6/1991 | Daly | 123/468 |
| 5,092,285 | 3/1992 | Beaber | 123/52 MB |
| 5,111,794 | 5/1992 | DeGrace, Jr. | 123/470 |
| 5,129,371 | 7/1992 | Rosalik, Jr. | 123/90.38 |
| 5,138,983 | 8/1992 | Daly | 123/52 MV |
| 5,163,406 | 11/1992 | Daly et al. | 123/52 MV |
| 5,474,035 | 12/1995 | Ming et al. | 123/41.86 |
| 5,477,819 | 12/1995 | Kopec | 123/184.42 |
| 5,642,697 | 7/1997 | Jahrens et al. | 123/184.21 |
| 5,653,201 | 8/1997 | Hosoya | 123/184.34 |
| 5,664,533 | 9/1997 | Nakayama et al. | 123/184.42 |
| 5,713,323 | 2/1998 | Walsh et al. | 123/184.42 |
| 5,715,782 | 2/1998 | Elder | 123/184.61 |
| 5,743,235 | 4/1998 | Lueder | 123/468 |
| 5,762,036 | 6/1998 | Verkleeren | 123/184.31 |
| 5,826,553 | 10/1998 | Nakayama et al. | 123/184.42 |
| 5,875,746 | 3/1999 | Izuo | 123/90.11 |

*Primary Examiner*—Weilun Lo
*Attorney, Agent, or Firm*—Jerome R. Drouillard

[57] ABSTRACT

A modular integrated intake manifold (10) for a V-type internal combustion engine (20). A fuel module (16) nests between cylinder heads (28, 30) and has through-passages (42) leading to intake valves in the heads. An air cleaner module (12), which has an air box (60) within which intake air is filtered, also closes on one of the heads (28) to cover the exhaust and intake valves and the valve operating mechanisms of that head. A plenum/runner module (14) has a plenum that closes on the other of the heads (30) to cover the exhaust and intake valves and the valve operating mechanisms of that head. Runners (160, 162, 164, 172, 174, 176) have respective combustion air entrances disposed within a plenum chamber space (142) of the plenum and run to the through-passages of the fuel module. The runners are part of a runner pack (132) that has both complete (160, 162, 164) and incomplete (166, 168, 170) runners and that when assembled into the plenum, completes the incomplete runners. The integrated manifold includes a self-contained PCV system (104, 106, 108).

5 Claims, 6 Drawing Sheets

PLENUM/RUNNER MODULE HAVING INTEGRATED ENGINE VALVE COVER

BACKGROUND OF THE INVENTION

1. Field of the Invention

This invention relates generally to internal combustion engines, and more specifically to a plenum/runner module that associates with an engine cylinder head in a new and useful way.

2. Background Information and Reference to Related Applications

Spark-ignited, fuel-injected internal combustion engines enjoy extensive usage as the powerplants of automotive vehicles. In a representative piston engine, an intake manifold conveys intake air to intake valves of engine combustion cylinders. The intake valves are normally closed but open at certain times during the operating cycle of each cylinder. Pistons that reciprocate within the engine cylinders are coupled by connecting rods to a crankshaft. When the intake valves are open, fuel, such as gasoline, is sprayed by electric-operated fuel injectors into intake air entering the cylinders, creating charges of combustion gases that pass through the open intake valves and into the combustion cylinders. After the intake valves close, the charges are compressed by the pistons during compression strokes and then ignited by electric sparks at the beginning of power strokes to thereby drive the pistons and power the engine.

Various intake manifold arrangements are documented in patent literature. Developments in materials and processes have enabled various parts of intake manifolds to be fabricated in ways that significantly differ from intake manifolds made by older metal casting and machining methods. The ability to fabricate intake manifold parts using newer processes offers a number of benefits, including for example and without limitation: opportunities to structure intake manifolds in novel configurations for design and/or functional purposes; realization of fabrication and assembly cost savings; shorter lead times from design to production; and more efficient use of engine compartment space in an automotive vehicle.

An automotive vehicle manufacturer may be able to attain even further productivity improvements through greater commonality of components across various engine models and through increased integration of individual component parts. For example, an intake manifold that efficiently integrates fuel-handling and air-handling systems may offer potential for significant productivity improvements, and if the systems are integrated in ways that embody an entire intake system as several devoted modules, post-manufacture servicing may be made easier at the same time that manufacturing cost efficiencies and economies of scale are being achieved.

In certain automotive vehicles, such as front-wheel drive vehicles, the engine compartment is at the front of the vehicle, and the engine may be disposed transverse to the length of the vehicle. Moreover, an engine compartment is typically crowded. Accordingly, convenient and expedient access to serviceables and consumables may be an important objective in the design of a vehicle, and the organization and arrangement of an intake manifold can play a significant role in attaining that goal.

SUMMARY OF THE INVENTION

The present invention relates to a plenum/runner module having an integrated valve cover that enables the module to enclose intake and exhaust valves and their associated operating mechanisms by mounting on an engine cylinder head. The disclosed preferred embodiment of plenum/runner module is portrayed in association with an air cleaner module, a fuel module, and a throttle module to form a modular integrated intake manifold for an engine.

The modular integrated intake manifold is the subject of a related pending patent application of even filing date naming the same inventors and entitled Modular Integrated Intake Manifold, U.S. Ser. No. 09/260,148. The air cleaner module is the subject of a related pending patent application of even filing date naming the same inventors and entitled Air Cleaner Module Having Integrated Engine Valve Cover, U.S. Ser. No. 09/259,447. The plenum/runner module is also the subject of a related pending patent application of even filing date entitled Plenum Module Having A Runner Pack Insert, U.S. Ser. No. 09/260,158.

A general aspect of the within claimed invention relates to an internal combustion engine comprising: a combustion cylinder bank comprising a head that include valves and operating mechanisms for operating the valves in suitably timed relation to engine operation for selectively allowing and disallowing ingress and egress of combustion and combusted gases into and out of combustion cylinders of the bank; and a plenum module comprising a plenum chamber space having a combustion air inlet through which air enters, runners for delivering air from the plenum chamber space to the cylinders, and a cover which closes on the head to cover the operating mechanism for operating the valves and at least a portion of which forms a wall portion of the plenum chamber space.

Other general and more specific aspects will be set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
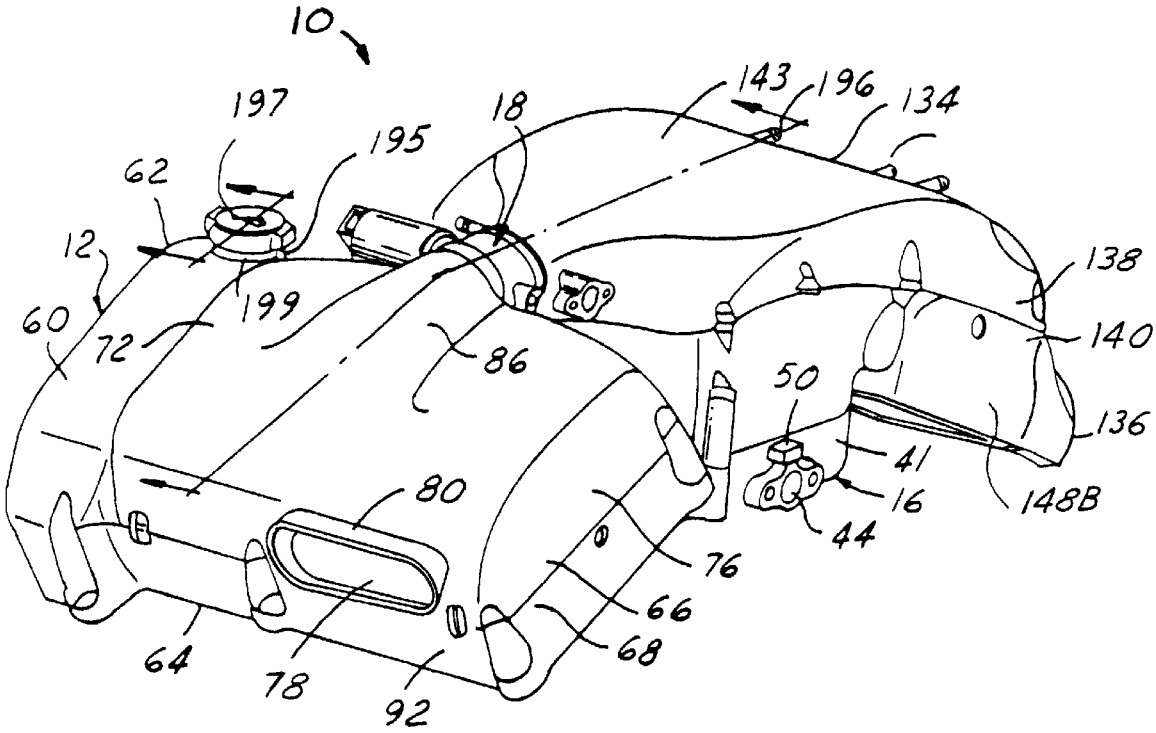
FIG. 1 is a perspective view of an intake manifold that includes an air cleaner module embodying principles of the present invention, a plenum/runner module, a fuel module, and a throttle module, in assembly.
Figure 4:
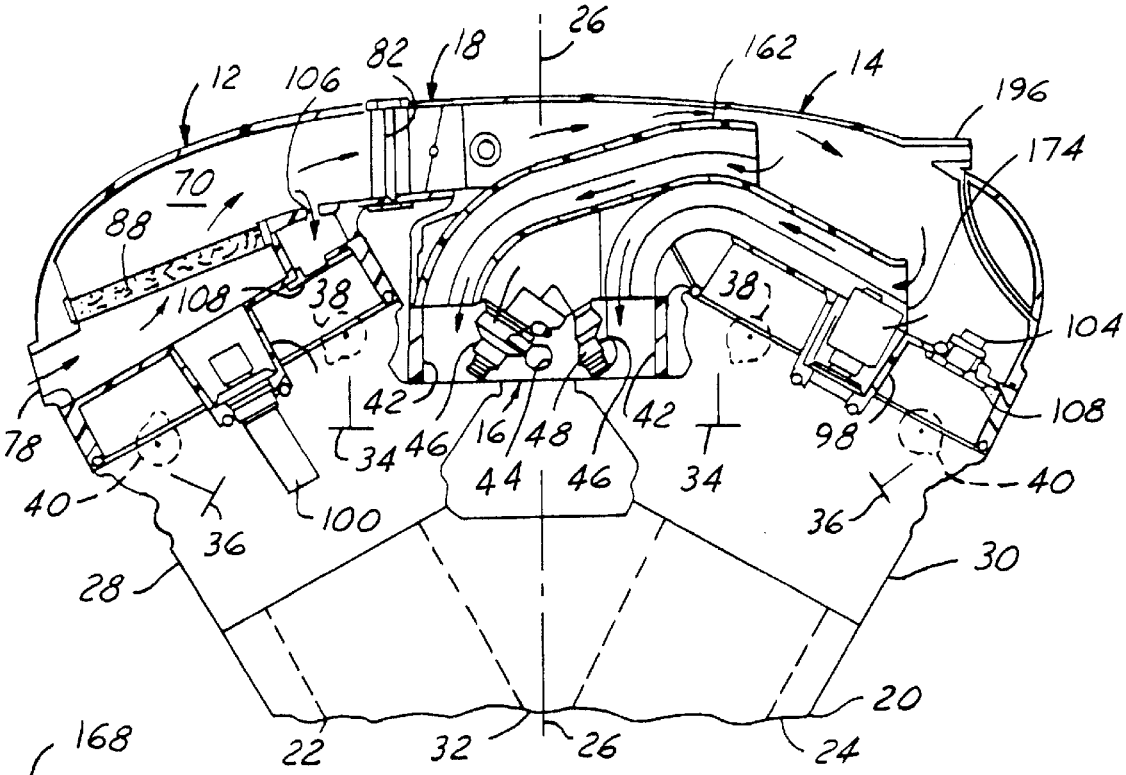
FIG. 4 is a cross section view in the direction of arrows 4—4 in FIG. 1.

FIG. 1 shows an intake manifold 10, including an air cleaner module 12, a plenum/runner module 14, a fuel module 16, and a throttle module 18, in assembly. Intake manifold 10 is adapted to mount on a spark-ignited, V-type internal combustion engine. FIG. 4 shows intake manifold 10 mounted on an upper portion of such an engine 20.

Engine 20 comprises first and second combustion cylinder banks 22, 24 disposed in angled relation to respective sides of an imaginary, horizontally and vertically expansive, longitudinal medial plane 26 of the engine so as to endow the engine with its V-shape. Cylinder banks 22, 24 comprise respective heads 28, 30 atop a cylinder block 32 containing cylinder bores defining the individual combustion cylinders within the banks. The illustrated embodiment has three cylinders per bank thereby making engine 20 a V-6 engine.

Cylinder heads 28, 30 include intake and exhaust valves for selectively allowing and disallowing ingress and egress of combustion and combusted gases into and out of the individual combustion cylinders. Respective operating mechanisms for operating the respective valves in suitably timed relation to engine operation also mount on the cylinder heads. In FIG. 4 these valves are depicted by the schematic representation of a single intake valve 34 and a single exhaust valve 36 in each cylinder bank 22, 24. Also schematically portrayed are respective valve operating mechanisms 38, 40. Although generic principles of the invention are not limited to any particular valve construction or particular valve operating mechanisms, representative mechanisms are multi-lobed camshafts that operate the valves through intermediate devices, such as valve rockers, in which case the valves may be spring-biased closed and forced open by lobes of the camshaft cams acting through associated rockers. Alternatively, the valve operating mechanisms may be individual electric actuators that act directly on the valves.

Fuel module 16 nests between heads 28 and 30 and comprises a fuel module body 41 that contains respective through-passages 42 leading to respective intake valves 34 for the respective combustion cylinders. The lengths of fuel module 16 and its body 41 run parallel to the horizontal expanse of medial plane 26. The lengths of through-passages 42 are disposed parallel to medial plane 26, with three disposed to one side of the plane and three others to the opposite side. A fuel gallery 44 runs centrally lengthwise within fuel module body 41 and opens at the nearer lengthwise end of body 41 as viewed in FIG. 1 in a manner providing for fluid-tight connection with a mating end of a fuel supply tube (not shown) through which the gallery is supplied with liquid fuel under pressure.

Fuel module body 41 further includes fuel injector cups 46 spaced in succession along the length of the fuel module, three cups to each side. The longitudinal axes of the cups are skewed to plane 26. Cups 46 are organized and arranged such that a portion of each cup's side wall tangentially intersects gallery 44 so that fuel in gallery 44 is available to a side inlet port in the body of a respective fuel injector 48 when the respective fuel injector is fully seated in fluid-tight relation within the respective cup. When a fuel injector is so seated, its nozzle end is poised to spray fuel toward a respective engine intake valve 34 for entrainment with combustion air that flows through the respective through-passage 42, thereby creating a combustible mixture that is subsequently ignited by electric spark within the respective combustion cylinder to power the engine.

Figure 3:
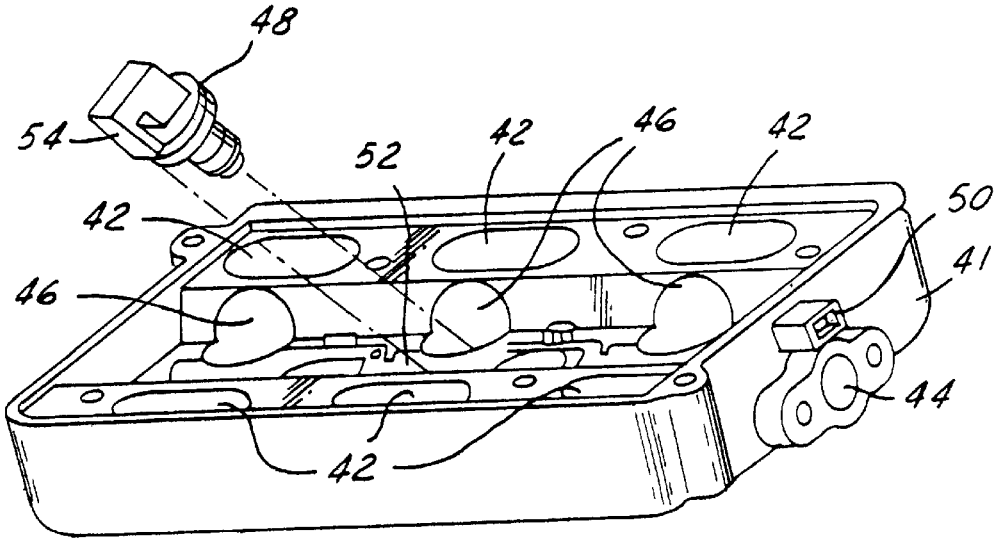
FIG. 3 is a perspective view of the fuel module from generally the same direction as the view of FIG. 1.

Operation of the fuel injectors is controlled in properly timed relation to the engine operating cycle by an electronic control module or unit (ECM or ECU) which is not shown in the drawings. For delivery of electric signals from the ECM or ECU to the respective fuel injectors, body 41 has a wiring connector 50 adjacent the fuel gallery opening. A mating wiring connector (not shown) connected to connector 50 delivers the electric signals to the fuel injectors. Fuel module 16 contains respective wiring runs from connector 50 to respective rectangular receptacles 52, each of which is proximately adjacent a respective cup 46. When a respective fuel injector is assembled into a respective cup in the manner suggested by FIG. 3, an electric plug 54 on the fuel injector mates to the respective receptacle 52 to complete the electric connection to the fuel injector, placing it under ECM or ECU control. When a fuel injector is operated by an electric signal, it opens to allow the pressure of fuel in gallery 44 to spray an injection of fuel from the injector's nozzle. While the fuel injection system just described is the type sometimes referred to as a dead-headed system because it has no excess fuel return, it is to be appreciated that certain inventive principles are generic to fuel systems other than the particular dead-headed one shown here.

Air cleaner module 12 comprises an air box 60 that is disposed atop cylinder head 28. Air box 60 may be considered to comprise a top 62 and a bottom 64 that fit together in a sealed manner along respective mating edges 66, 68 to cooperatively enclose an air box space 70. The illustrated air box may be considered to have a somewhat rectangular shape that comprises a top wall 72 contained wholly in top 62, a bottom wall 74 contained wholly in bottom 64, and a four-sided side wall 76 that extends between walls 72 and 74 and that is essentially entirely contained in top 62. It is top wall 72, bottom wall 74, and side wall 76 that bound air box space 70.

One side of side wall 76 that faces away from plenum module 14 contains a combustion air inlet 78 to air box space 70. Inlet 78 is oval, being bounded by an oval-shaped lip 80 formed in top 62 to protrude outward from air box space 70. A combustion air outlet 82 is provided in the side of side wall 76 that is opposite inlet 78, but is located more centrally of the long dimension of the side wall than inlet 78. Outlet 82 has a shape, circular for example, that is circumscribed by a tubular flange 84 formed in, and protruding outwardly from the exterior of, top 62. Where flange 84 merges with top wall 72, the latter includes a smoothly contoured rise 86 that transitions approximately an upper semi-circumference of flange 84 to an adjoining area of the top wall.

An air filter element 88 for filtering certain particulate material from combustion air that passes through air box 60 is disposed within air box space 70. Air filter element 88 has an expanse that is approximately parallel with top wall 72 and with bottom wall 74. The perimeter margin of the expanse of element 88 is captured against a ledge or groove within top 62 so that before it can exit through air outlet 82, air that has entered space 70 through inlet 78 is constrained to pass through a particulate filter medium 90 of element 88 circumscribed by the captured perimeter margin of the element. Hence, air filter element 88 divides air box space 70 into an upstream zone between itself and inlet 78 and a downstream zone between itself and outlet 82.

On its exterior, bottom 64 has a rectangular perimeter rim wall 92 that, in outward appearance, forms a continuation of side wall 76, protruding below bottom wall 74. In cooperation with bottom wall 74, wall 92 creates a downwardly open rectangular cavity in bottom 64. Wall 92 has a continuous grooved edge for containing a continuous gasket 94 for sealing the edge of wall 92 to head 28 when air cleaner module 12 is assembled to engine 20. The downwardly open cavity provided in bottom 64 therefore allows air cleaner module 12 not only to form a portion of the engine air intake system, but also to cover and enclose valves 34, 36 of head 28 and the associated valve operating mechanisms 38, 40.

Furthermore, bottom wall 74 contains three generally cylindrical wells 98, each in overlying relation to a respective one of the three combustion cylinders of cylinder bank 22. A coil-on-plug type spark plug 100 (the coil isn't shown) passes through, and is sealed to, a hole in the bottom of each well 98. The bottom of each well comprises a grooved circular rim that faces away from the well and contains a gasket 102 for sealing the bottom of the well to cylinder head 28 around plug 100.

Throttle module 18 is representative of a throttle body 120 having a circular through-bore 122 through which intake air enters the engine. A collar 125 couples the entrance of through-bore 122 to air outlet 82 in a sealed manner. The exit of through-bore 122 fits to a circular combustion air inlet 124 of plenum/runner module 14, also in a sealed manner. A throttle blade, or plate, 126 is disposed within through-bore 122 for selective positioning about a transverse axis 128 to selectively restrict flow through the through-bore.

Plenum/runner module 14 comprises a walled plenum 130 that is disposed atop cylinder head 30 and that also contains an internal runner pack 132. Plenum 130 may be considered to comprise a top 134 and a bottom 136 that fit together in a sealed manner along respective mating edges 138, 140 to cooperatively partially enclose a plenum chamber space 142. Enclosure of plenum chamber space 142 is completed by the cooperative association of a portion of bottom 136 and fuel module body 41, as will become more apparent as the description proceeds.

The illustrated plenum 130 may be considered to comprise a top wall 143 contained wholly in top 134 and a bottom wall 144 that is cooperatively formed by bottom 136 and fuel module body 41. Plenum 130 may further be considered to have a side wall 146 which extends between walls 143 and 144. Respective first and second portions of side wall 146 are contained in top 134 and bottom 136 respectively. Therefore it is top wall 143, bottom wall 144, fuel module body 41, and side wall 146 that bound plenum chamber space 142.

On its exterior, bottom 136 has a rectangular perimeter rim wall 148 that is correspondent in both construction and purpose to perimeter rim wall 92 of air cleaner module 12. Perimeter rim wall 148 protrudes below the portion of bottom wall 144 contained in bottom 136. As viewed externally, a first side 148A of wall 148 appears as a downward extension of one of the sides of side wall 146, and second and third sides 148B, 148*c* of side wall 148 appear as downward extensions of portions of the two adjoining sides of side wall 148 that are immediately contiguous the first side. The fourth side 148D of wall 148 extends generally parallel to the first side 148A. In cooperation with bottom wall 144, wall 148 creates a downwardly open rectangular cavity in bottom 136. Wall 148 has a continuous grooved edge for containing a continuous gasket 150 for sealing the edge of wall 148 to head 30 when plenum/runner module 14 is assembled to engine 20. The downwardly open cavity provided in bottom 136 therefore allows plenum/runner module 14 not only to form a portion of the engine air intake system, but also to cover and enclose valves 34, 36 of head 30 and the associated valve operating mechanisms 38, 40.

Furthermore, bottom wall 144 contains three generally cylindrical wells 98 correspondent in purpose and construction to wells 98 of air cleaner module 12. Each well 98 overlies a respective one of the three combustion cylinders of cylinder bank 24, and a coil-on-plug type spark plug 100 passes through, and is sealed to, a hole in the bottom of each well. A coil 101 is shown disposed on an upper end of plug 100. The bottom of each well comprises a grooved circular rim that faces away from the well and contains a gasket 102 for sealing the bottom of the well to cylinder head 30 around plug 100.

With top 134 and bottom 136 in assembly as described, plenum/runner module 14 still has a bottom opening alongside the downwardly open cavity that covers and encloses valve operating mechanisms 38, 40 and the valves 34, 36 which it operates. That bottom opening is circumscribed by a perimeter edge that when module 14 is assembled to engine 20, seals to the perimeter margin of the top surface of fuel module body 41, thereby completing the enclosure of plenum chamber space 142.

Runner pack 132 may be considered an insert that is joined with the wall of plenum 130 during the process of fabricating module 14. Runner pack 132 comprises a set of three complete runners 160, 162, 164 for respective association with respective combustion cylinders of cylinder bank 22, and a set of three incomplete runner portions 166, 168, 170 for respective association with bottom 136 to create respective complete runners 172, 174, 176 for respective combustion cylinders of cylinder bank 24. When runner pack 132 is joined to plenum 130, respective walled channel portions 178, 180, 182 in bottom 136 associate with respective incomplete runner portions 166, 168, 170 to create the respective complete runners 172, 174, 176.

Each of the six runners comprises a respective runner passage that has a respective entrance end open to plenum chamber space 142 and a respective exit end registered with a respective through-passage 42 in fuel module body 41.

For tuning purposes, each runner has a prescribed length. In the particular embodiment illustrated, these lengths are essentially identical. The shapes of runners 160, 162, 164 are also essentially the same, but those of runners 172, 174, 176, while essentially identical among themselves, differ from the shapes of runners 160, 162, 164. Runners 172, 174, 176 happen to be more sharply curved than runners 160, 162, 164 as they transition to fuel module body 41 in this particular engine module. Specific runner shapes and geometries for any particular engine will depend on the particular engine module, and so certain general principles of the invention extend to runner pack constructions other than the specific one now being disclosed and described.

Figure 7:
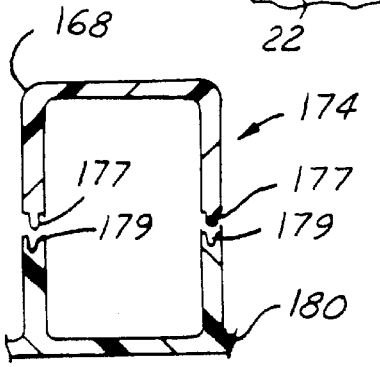
FIG. 7 is an enlarged fragmentary cross section view in the direction of arrows 7—7 in FIG. 6.
Figure 7A:
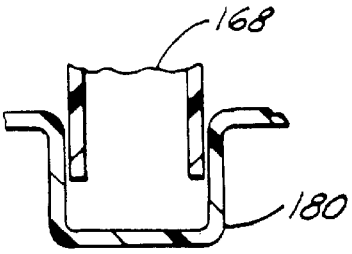
FIG. 7A is a view similar to FIG. 7 showing a modified form.

Each of the three runners 160, 162, 164 for cylinder bank 22 shares a portion of its wall with a respective incomplete runner 166, 168, 170 for cylinder bank 24. Additional to the portion that each incomplete runner 166, 168, 170 shares with a respective runner 160, 162, 164, the respective incomplete runner has side walls that extend to fit associatively with the respective walled channel portion 178, 180, 182 in bottom 136, thereby completing the definition of runners 172, 174, 176. Each walled channel portion 178, 180, 182 has spaced apart side walls that are bridged at their bottoms by a bottom wall. Each of the two side walls of an incomplete runner have tongues 177 that run along their free edges for conforming fits to grooves 179 that run along free edges of side walls of channel portions 178, 180, 182 in the manner of FIG. 7 for runner 174. FIG. 7A shows a modification in which opposite side walls of each incomplete runner 166, 168, 170 fit just inside a corresponding one of two side walls of the respective walled channel portion 178, 180, 182, placing them in mutually overlapping relation along the length of each side of the respective completed runner 172, 174, 176.

Because runners 178, 180, 182 are internal to plenum/runner module 14, an air-tight seal between each pair of their side walls which are mutually associated either by tongue-and-groove fits (FIG. 7) or overlapping (FIG. 7A) along their lengths is believed non-essential, provided that sufficiently close dimensional fitting is achieved. Depending on design dimensions and physical characteristics of materials, it may be possible for runner pack 132 to directly force- or snap-fit to bottom 136 without using additional parts such as fasteners and/or gaskets. Moreover, the use of a runner pack, as described, allows runner length to be changed without changing top 134 or bottom 136, albeit within obvious limits for a particular plenum chamber space geometry, by utilizing different runner packs in which the length of any particular runner, be it complete or incomplete, can be selected within limits imposed by the shape and volume of plenum chamber space 142. This can be advantageous during engine development because it allows an engine intake manifold to be better tuned to an engine within the volumetric envelope defined by top 134 and bottom 136 simply by substituting a new and different runner pack for a previous one.

Figure 2:
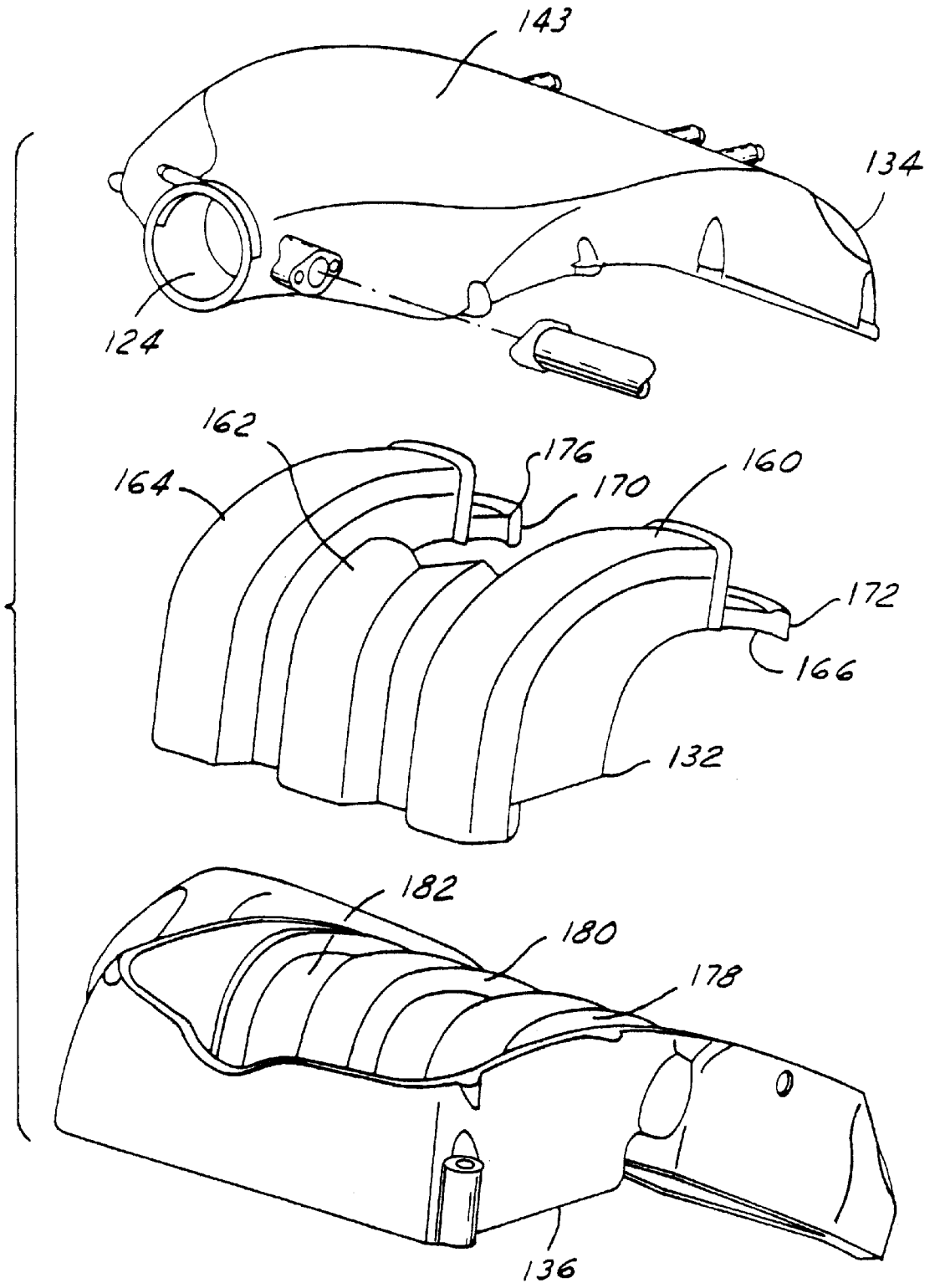
FIG. 2 is an exploded perspective view of the plenum/runner module from generally the same direction as the view of FIG. 1.

FIGS. 2 and 4 show the three incomplete runner portions 166, 168, 170 to have certain lengths. The lengths of the walled channel portions 178, 180, 182 formed in bottom 136 are actually longer, but stop short of side 148A. Hence, the lengths of the incomplete runner portions, could be made longer in the direction marked by the reference arrow 183, if it were appropriate to do so. Such increases in length would make the completed runners 172, 174, 176 longer without requiring change in the construction of bottom 136.

The closure of heads 28 and 30 by the downwardly open cavities of air cleaner module 12 and plenum/runner module 14 provides for a self-contained PCV (positive crankcase ventilation) system in intake manifold 10. A PCV valve 104 mounts in a hole in wall 144. Valve 104 has an outlet that is open to plenum chamber space 142 and an inlet that is open to the space bounded by the downwardly open cavity of module 14. Engine 20 contains internal breather passages from each of the downwardly open cavities of modules 12 and 14 to the engine crankcase. A ventilation port 106 is provided in module 12 to allow filtered air to pass through wall 74. When valve 104 is opened by vacuum in plenum chamber space 142, fresh air is sucked through port 106, and through one or more breather passages that extend through cylinder bank 22 to the engine crankcase. There the fresh air scavenges internally generated gases, including combustion blow-by gases, and the scavenged gases are sucked out of the crankcase through one or more breather passages that extend from the engine crankcase through cylinder bank 24, and through valve 104 to plenum chamber space 142. There they entrain with intake air that has passed through throttle module 18 ultimately to be combusted in the engine cylinders. Elements, such as baffles 108, are disposed in underlying relation to each of PCV valve 104 and ventilation port 106 to block oil splash that may occur within the cavities of modules 12 and 14 that enclose the respective operating mechanisms 38, 40 and valves 34, 36 of the respective cylinder banks 22, 24. The baffles may be of any suitable construction that allows gas, but not liquid, to pass freely into and out of the spaces enclosed by the cavities. With the disclosed arrangement, no individual hoses need be connected to PCV valve 104 because its inlet port is disposed directly in the enclosed valve cover space and its outlet is disposed directly in the plenum chamber space.

Fuel module 16 can be fabricated and tested by known methods and procedures like those used in the fabrication and testing of fuel rails. Fuel module 16 is assembled as a unit to engine 20. Suitable fastening and sealing devices are employed at locations appropriate to a particular design to secure fluid-tightness at all joints.

The other three modules 12, 14, 18 can be fabricated and tested individually. The ability to first assemble the three modules together as a unit and then mount that unit on an engine is an advantageous aspect of the invention. It is alternately possible for modules to be assembled to an engine on an individual basis when appropriate. Suitable fastening and sealing devices are employed at locations appropriate to a particular design to secure fluid-tightness at all joints.

The complete intake manifold 10 mounted on engine 20 provides a functional, serviceable, and aesthetically pleasing assembly that is characterized by the various advantages mentioned earlier. Other beneficial aspects of the invention may suggest themselves although they may not have been specifically mentioned. It can be seen that various nipples 196 are integrally formed in top 134 to provide integral vacuum ports for delivery of vacuum to various devices that utilize intake manifold vacuum. Various individual component parts are fabricated of materials suited for the environmental extremes encountered in the engine compartment of an automotive vehicle.

Figure 8:
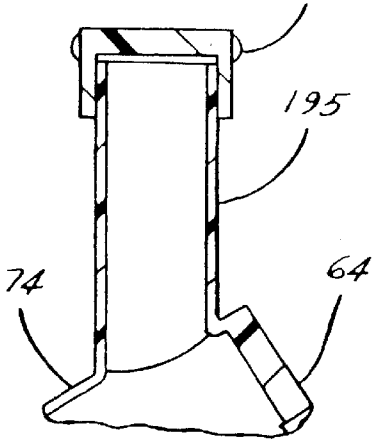
FIG. 8 is a cross section view in the direction of arrows 8—8 in FIG. 1.
Figure 6:
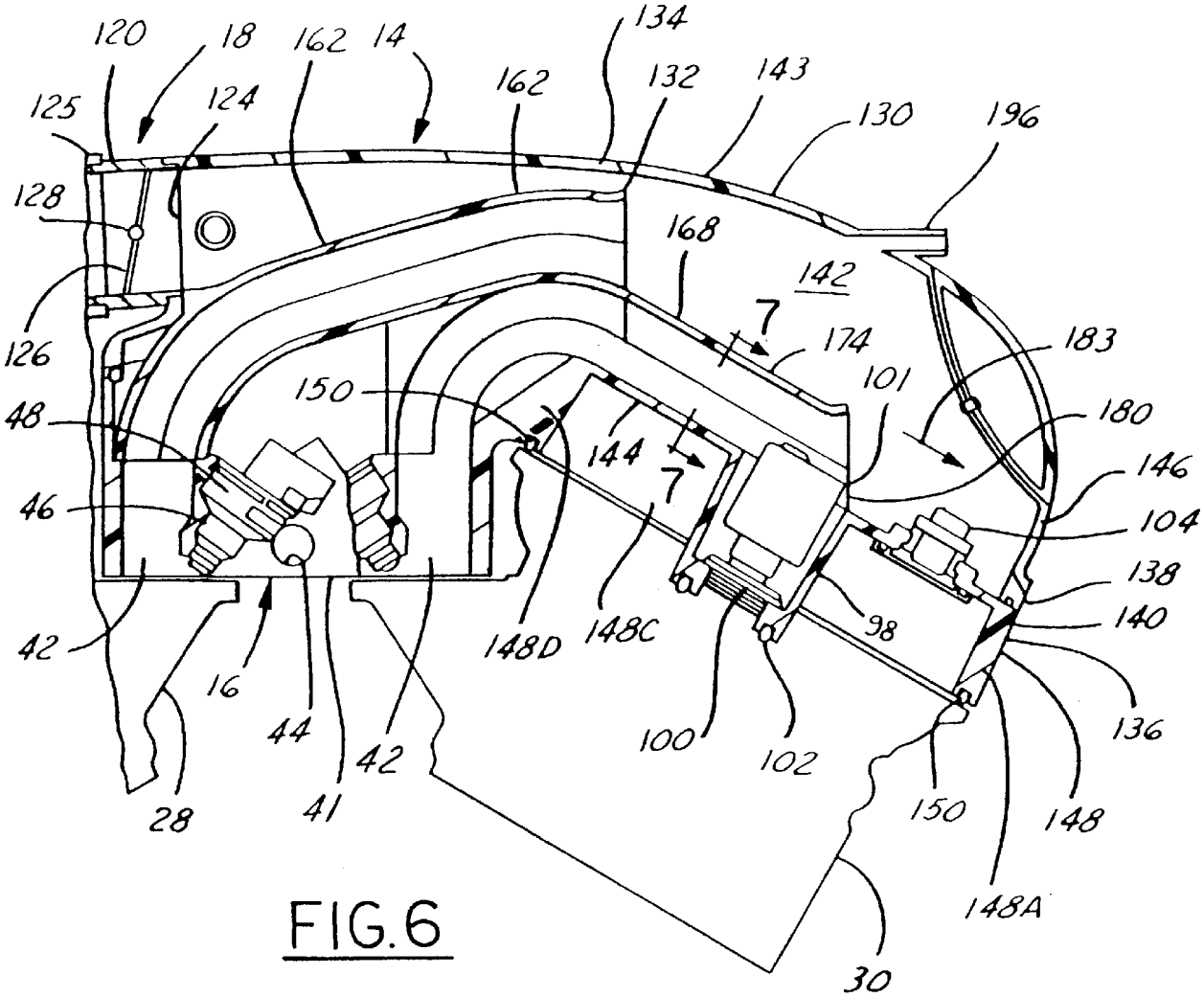
FIG. 6 is an enlarged view of the right half of FIG. 4 to show more detail.

A further feature that is useful for engine service and maintenance is the inclusion of an integral oil filler tube in one of the modules 12, 14. FIG. 8 shows such a tube 195 formed integrally with bottom 64 of air cleaner module 12. Tube 195 comprises a lower end that merges with bottom wall 74 such that the tube opens to the space enclosed by the downwardly open cavity of bottom 64 that overlies and encloses valves 34, 36 and operating mechanisms 38, 40. Tube 195 rises upward to an open upper end that is closed by a removable cap 197. Depending on various considerations in the design of a particular intake manifold, tube 195 may, or may not, pass through the interior of air box 60. If the tube were to pass through, the air box would require holes through which the tube could pass. If the holes intercepted air box space 70, sealing of the exterior of the tube would be sealed in any suitable fashion to the holes. Rather than penetrating air box 60, the illustrated tube 195 passes exteriorly adjacent, and the illustrated air box has a recess 199 allowing the tube to pass by in a desired manner. When cap 197 is removed from tube 195, motor oil for the engine may be introduced through the tube into the region of the valves and their operating mechanisms in bank 22. The oil can drain to the engine crankcase through internal oil passages.

Figure 9:
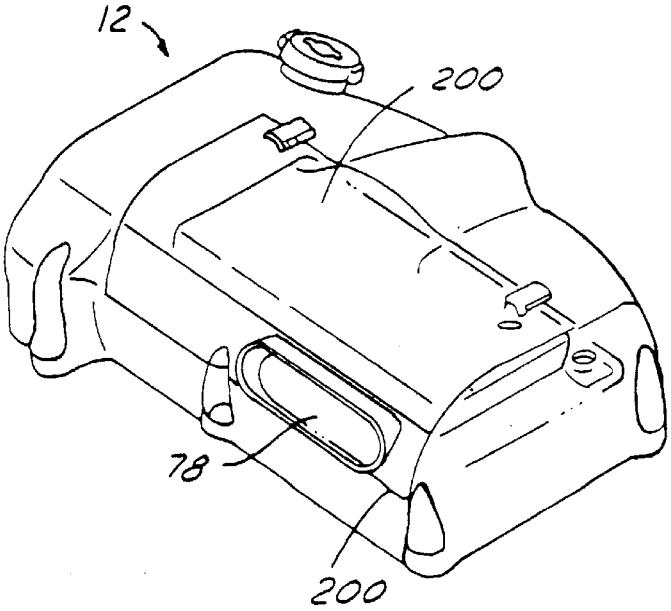
FIG. 9 is a perspective view of a modified form of air cleaner module.
Figure 5:
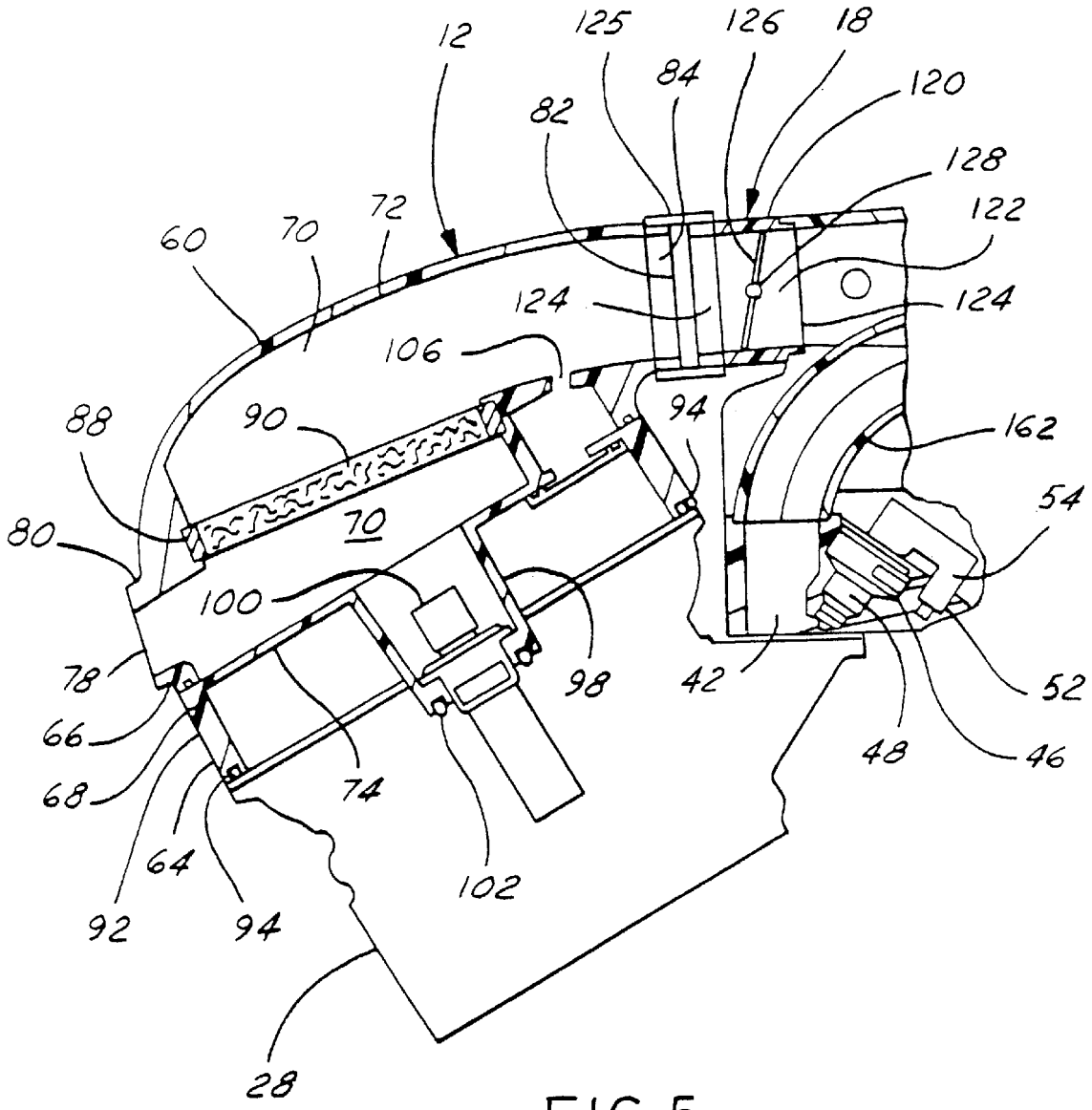
FIG. 5 is an enlarged view of the left half of FIG. 4 to show more detail.

FIG. 9 shows an embodiment of air cleaner module 12 that has been modified to include an access cover 200 that is fastened in covering relation to an access opening to air box space 70. Inlet 78 may be provided in cover 200 as shown. A fastening arrangement can provide for cover 200 either to be moved out of the way, or completely removed, to allow access to space 70. It enables element 88 to be visually observed and a used element 88 to be conveniently replaced by a fresh one when needed.

Figure 10:
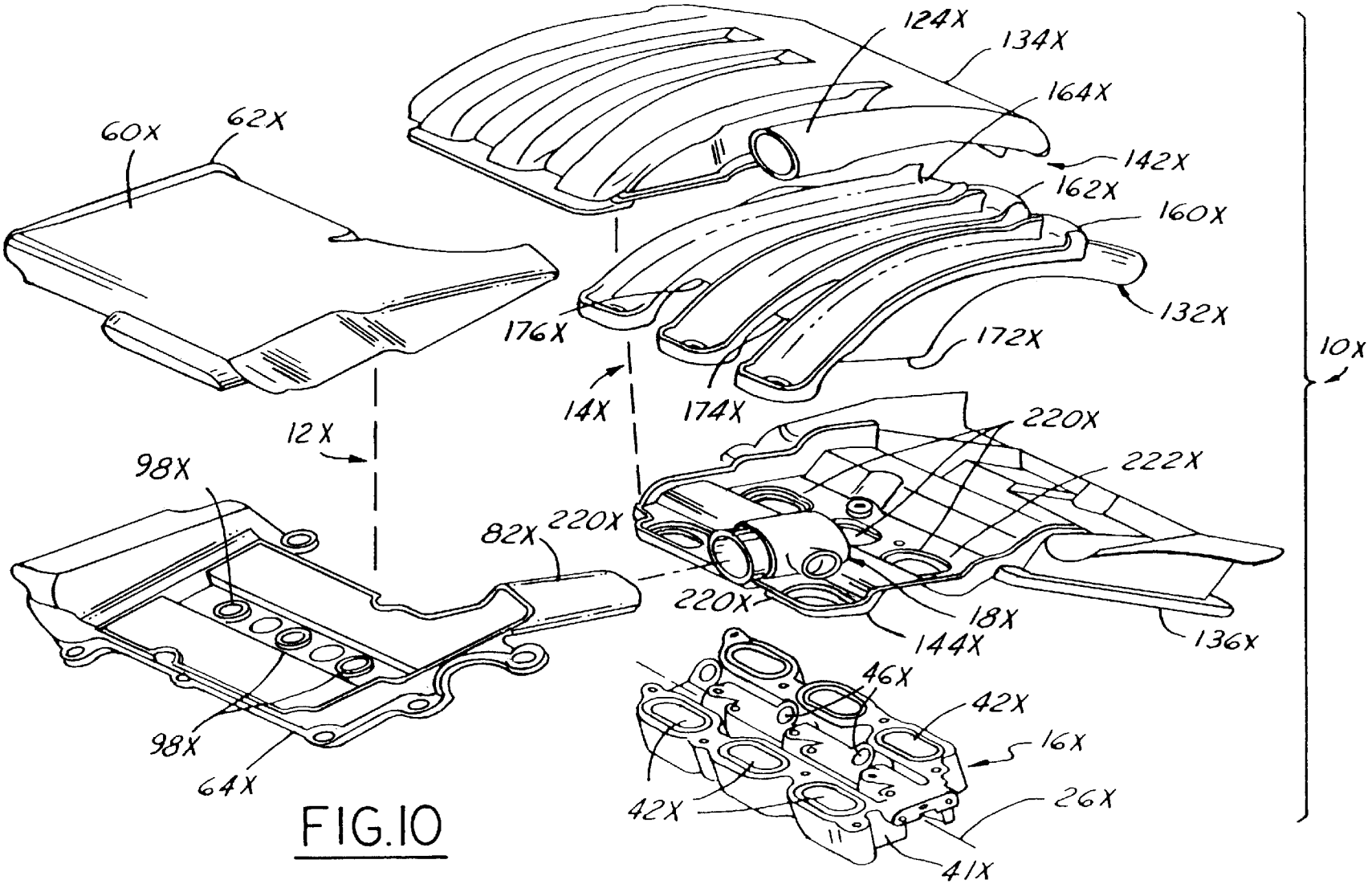
FIG. 10 is an exploded perspective view of another embodiment of intake manifold including an air cleaner module that embodies principles of the present invention.

FIG. 10 discloses a second embodiment that comprises the same basic modules as the first. The same base reference numerals are used in FIG. 10 to identify elements that correspond to like elements identified by the same base reference numerals in the first embodiment, except that the numerals have been suffixed by the suffix X in FIG. 10. For conciseness, the following description of FIG. 10 will focus on certain differences between the two embodiments, but it is to be understood that lack of any specific description, despite apparent differences in the drawing Figures, should not be construed to imply that there are in fact no differences nor that such differences are trivial.

Therefore, modules 12X, 14X, 16X, and 18X which constitute intake manifold 10X cooperate in the same manner as their counterparts of the first embodiment. They also share the same general construction features. While there are obvious differences in appearance, the following structural differences will now be described.

Throttle module 18X is not centrally located along the horizontal expanse of medial plane 26X, but rather is toward the near end of the engine as viewed in FIG. 10. Air outlet 82X is a distinct tube formed in bottom 64X also toward the near end of the engine as viewed in FIG. 10. Air inlet 124X is also formed as a distinctive tube in top 134X. The arrangement of FIG. 10 differs from that of intake manifold 10 in that air enters plenum chamber space 142X at a greater distance from air cleaner module 12X, specifically entering at a point beyond the entrances of runners 160X, 162X, 164X, 172X, 174X, and 176X, as well as to one side of all runners.

Another difference is in runner pack 132X where it is runners 172X, 174X, and 176X that are complete runners, whereas the runner pack provides incomplete portions of runners 160X, 162X, and 164X. The latter three runners are completed by the joining of runner pack 132X to top 134X. Rather than utilizing fuel module body 41X to complete the enclosure of plenum chamber space 142X when module 14X is assembled to the engine, bottom 136X is constructed to extend bottom wall 144X to overlie the top of fuel module body 41X. It comprises six oval through-holes 220X centered in respective depressions 222X. The mating ends of the runner pack runners are shaped to seat in these depressions and register their outlets with the through-holes. A suitable gasket (not shown) seals between fuel module body 41X and the overlying portion of bottom wall 144X.

While certain aspects of the inventive principles may be applicable to a V-type engine, as illustrated, other aspects may be useful in other engine configurations, potentially extending to non-Otto cycle engines. It is to be appreciated that certain details of the embodiments that do not bear directly on the inventive principles may have been neither specifically illustrated nor explicitly described, and it should be understood that good engineering and manufacturing practices are to be employed in practicing the inventive principles in their application to particular engine models.

While a presently preferred embodiment has been illustrated and described, it is to be appreciated that the invention may be practiced in various forms within the scope of the following claims.

What is claimed is:

1. An internal combustion engine comprising:

a combustion cylinder bank comprising a head that include valves and operating mechanisms for operating the valves in suitably timed relation to engine operation for selectively allowing and disallowing ingress and egress of combustion and combusted gases into and out of combustion cylinders of the bank;

a throttle module comprising a throttle valve for throttling combustion air; and a plenum module comprising a plenum chamber space receiving combustion air from the throttle module, runners for delivering air from the plenum chamber space to the cylinders, and a cover which closes on the head to cover the operating mechanism for operating the valves and at least a portion of which forms a wall portion of the plenum chamber space; in which the cover comprises a downwardly open recess that is cooperatively defined by the portion of the cover that forms a wall portion of the plenum chamber space and by a side wall that bounds the recess by extending from the portion of the cover that forms a wall portion of the plenum chamber space to a perimeter edge that seals to the cylinder head.

2. An engine as set forth in claim 1 in which the engine includes electric devices mounted on the cylinder head for initiating combustion events in the combustion cylinders, and the cover comprises integral wells each of which circumferentially surrounds a respective electric device and has a bottom wall containing an opening through which the respective electric device passes and closing against the cylinder head in circumferentially surrounding relation to the respective electric device.

3. An engine as set forth in claim 1 in which the runners have entrances disposed within the plenum chamber space, and lengths that extend within the plenum chamber space from the entrances.

4. An engine as set forth in claim 1 in which a PCV valve is disposed on the cover and comprises an inlet open to the recess and an outlet open to the plenum chamber space.

5. An engine as set forth in claim 4 including a baffle disposed in covering relation to the PCV valve inlet to block motor oil splash from the PCV valve inlet without obstructing gas flow to the PCV valve inlet.

* * * * *